United States Patent [19]

Bell

[11] Patent Number: 4,470,044

[45] Date of Patent: Sep. 4, 1984

[54] MOMENTARY VISUAL IMAGE APPARATUS

[76] Inventor: Bill Bell, 56 Perry St., Brookline, Mass. 02146

[21] Appl. No.: 264,193

[22] Filed: May 15, 1981

[51] Int. Cl.[3] ..... G09G 3/00

[52] U.S. Cl. ..... 340/755; 340/791; 358/89; 358/240

[58] Field of Search ..... 340/755, 792, 791; 351/209, 210; 358/89, 88, 240

[56] References Cited

U.S. PATENT DOCUMENTS

| | | | |
|---|---|---|---|
| 2,018,873 | 10/1935 | Ramsey | 358/240 |
| 3,493,956 | 2/1970 | Andrews et al. | 340/792 |
| 3,636,837 | 1/1972 | McNaney | 340/755 |
| 3,737,722 | 6/1973 | Scharlack | 340/755 |
| 3,744,048 | 7/1973 | Treichel | 340/755 |
| 3,846,784 | 11/1974 | Sinclair | 340/755 |
| 3,958,235 | 5/1976 | Duffy | 340/755 |
| 4,160,973 | 7/1979 | Berlin, Jr. | 340/755 |
| 4,162,493 | 7/1979 | Ross et al. | 340/755 |
| 4,298,868 | 11/1981 | Spurgeon | 340/755 |
| 4,311,999 | 1/1982 | Upton et al. | 340/755 |

*Primary Examiner*—Marshall M. Curtis

[57] ABSTRACT

A modulated array of lights for the creation of momentarily perceptible visual images when scanned asynchronously by the human eye during characteristic saccadic eye movements between points of eye fixation is described in the disclosure. The array and modulation style are chosen to provide an image that matches the span of the human eye/brain combination for recognition of tachistroscopically presented lines of text, other symbols, and pictoral images, and to achieve an illusory effect wherein the momentary image appears dissociated from the array of lights and appears superimposed on the scene of eye fixation just prior to initiating the saccadic movement. A preferred embodiment using light emitting diodes and large scale integrated logic circuitry is described for generation of words, phrases up to 32 characters long, and simple pictures.

9 Claims, 6 Drawing Figures

MOMENTARY VISUAL IMAGE APPARATUS

DESCRIPTION

BACKGROUND OF THE INVENTION

1. Technical Field

This invention pertains in part to the art of visual communication of symbols and pictures by means of a modulated array of discrete light producing elements which array is smaller in number than the number of elements in the visual scene to be communicated. Also, this invention pertains in part to the art of tachistoscopy wherein visual images are flashed for brief intervals in the field of view of an observer or test subject. And in addition, this invention pertains to the art of creating a visual illusion, wherein the observer perceives images as originating from locations where there is no apparent source.

2. Background Art

Signs, data displays and pictoral displays using discrete light producing elements in an n×m array and modulated in intensity to form letters and pictures that are stationary or that move are well known.

A switching light source such as light emitting diodes, cathode ray tube phosphors, and gas discharge tubes permitted the invention of synthetic n×m arrays wherein a smaller number of light sources are made to move by mechanical means or to apparently move by mechanical and optical means, or by electromagnetic deflector means, and so to produce light in successive segments from n×m locations, the motion/apparent motion and modulating means being done quickly and repetetively so that the well known persistance characteristic of the eye causes the observer to see a complete, steady and constant image, provided he fixes his gaze on the area where the synthetic display is being generated, and provided the scanning means is synchronised to the light modulating means. See for example U.S. Pat. No. 4,099,172, Montanari et al.

The present invention departs from the prior art in that means for moving the light producing elements are omitted from the display device. Instead, the array is fixed in space and modulated in a manner attuned to characteristic scanning motions of the human eye, so that the information is perceived for a short interval after the observers eyes are in motion relative to the array during which interval the eye is normally unreceptive to visual information. This technique achieves an unusual illusory effect of producing a momentary perceptible image in a space dissociated from the actual array of light producing elements.

Although the present invention is simpler than the prior art in that scanning means are obviated and therefore smaller sizes can be achieved; the resultant visual effect is sufficiently different, having new and different applications, so that it is in a class apart from the prior art.

SUMMARY OF THE INVENTION

In human vision the eyes fixate for a period of time on one point in the visual scene then rapidly move to fixate on another point for a period of time and so on. The rapid jerky movements between points of fixation is so instinctive and natural that most people are unaware of it. Psychologists refer to these eye movements, which may also involve some head movement, as "saccadic" movements. Researchers in psychology of vision have made measurements of the angular rate of saccadic eye movement and found the angular rate to be quite uniform from person to person, and largely not consciously controllable. Angular rates reach a peak at the middle of the saccadic movement, and may be about 220–250 degrees per second for movements of 5° in angle and about 450–500 degrees per second for movements of 20° in angle.

During saccadic movement, stationary objects in the field of view are not clearly perceived, but an image of the previous scene fixed upon persists for up to about ¼second, with diminishing intensity. The previous image is immediately supplanted by a new image as the eye rests on the next point of fixation, typically within 1/15 to 1/25 second. This action, which may be easily demonstrated using a device as described in the present invention, takes place so rapidly that one is aware only of a smooth continuum of vision, free from blue caused by movement.

Another characteristic of human vision is the span of information perception of recognition, which is partly a function of the visual accuity of the central field of the eye and partly a function of the brain. By presenting images to a human observer for brief durations of 1/1000 to 1 second using a tachistoscope, an instrument well known in the field of vision research, other researchers have shown that for example a whole word or group of words can be accurately perceived even at the shortest of exposures provided that the images were sufficiently near the eye's central field of view, the macular or foveal region, and the eyes were focused and fixated.

It is the purpose of the present invention to create a brief image on the retina of the eye during saccadic motions, which image will be perceptible and recognisable to the observer, and which will be superimposed on the rapidly decaying image of the prior point of fixation.

The subject invention achieves this effect by modulating a static array of light producing elements as the central field of view of the eye sweeps across the array in saccadic motion. The image thus impressed on the retina, because of the well known persistence effect, will seem to the eye/brain combination to be a static image created by the momentary simultaneous flash of an extended array of light sources. This image will blend with this decaying image of the scene of previous fixation and appear to be a part of it.

The array of light sources and means for modulating these can be made quite simply as will become apparent in the following descriptions. Because the array is static and without optical or mechanical means to create a synthetic array, the burden of scanning the device is placed on the observer. However, since the invention is attuned to a largely unconscious act on the observers part, the effort will be of little consequence to the observer in envisioned applications of the invention.

The effect produced by the momentary visual image when first seen is startling and baffling, thus attracting the observers attention. Because of this effect, the subject invention has value as an eye catching component of a visual display such as used in advertising. The subject invention has many other applications as well. For example, the subject invention can be used for the study of human visual perception of symbols, as an aid in teaching reading skills, as a word-guessing game, as novelty jewelry, as a novelty greeting device, as an annunciator, as an identifying marker such as for airports at night, as a marker to identify stations along a railroad at night or underground while the observer is in motion, as an artistic or decorative object.

The subject invention has the novel attribute of conveying visual information to an observer during intervals when the observers eyes are undergoing rapid angular motion with respect to the visual scene and hence all other objects in the scene are rendered as an undistinguishable blur. The subject invention has a second novel attribute in that the visual information conveyed is made to appear displaced from the source of light and to appear superimposed on the visual scene viewed by the observer prior to saccadic scanning of the source of light.

In addition, the subject invention is simlpler in construction than synthetic array displays, which require motion to achieve the effect of extending the image; hence the subject invention is cheaper, more reliable, and occupies less space compared with a device of the prior art for generating an image of equivalent size.

As an example of the use of this subject invention's novel attributes in an advertising display, a picture of the advertised product can be placed adjacent to the subject invention such that the name of the product appears to flash across the picture of the product.

As a means for teaching reading skills, the written name of an object can be made to flash across a picture of the object, or across a sample of the object if it is placed adjacent to the subject invention. This creates a direct association between object and the written word, and the startling method of presenting this written word provides a learning incentive.

The subject invention has application in another instance where the observers eyes are in rapid motion with respect to the visual scene, such as on a fast moving vehicle. For example, a railroad passenger would have difficulty reading outside printed matter set close to the track, where the subject invention would be plainly readable in the same circumstance.

The subject invention has an appealing simplicity of form when viewed in the standard manner of eye fixation. Thus a purely functional display such as a time-of-day indicator can be made more aesthetically appealing.

These and other details of my invention will be described in connection with the accompanying drawings, which are furnished only by way of illustration and not in limitation of the invention.

DESCRIPTION OF THE PREFERRED EMBODIMENT

Figure 1:
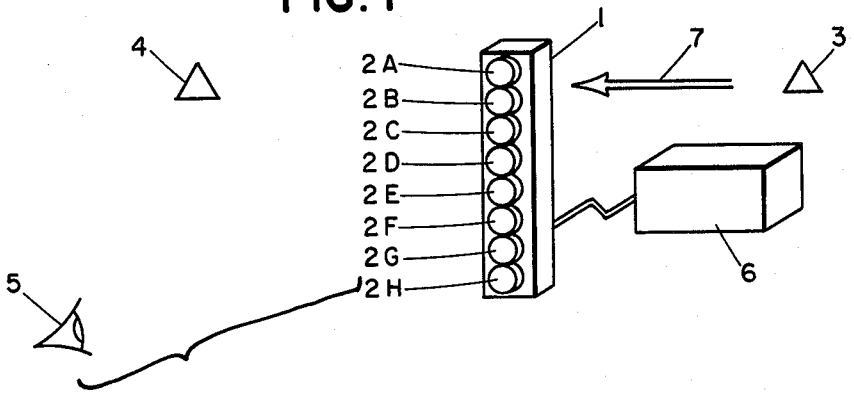
FIG. 1 is a perspective view of a representative array of light producing elements in linear form as would be seen in use by an observer.

FIG. 1 shows a linear array (1) of light producing elements (2*a*) through (2*h*) as it would appear to an observer (5). The light producing elements (2) can be light emitting diodes (LED's), or such other source to be described below, that may be switched within about 1 to 5 microseconds, that may be closely spaced and that have the general shape of a disc or square. The number of elements in the array may be as few as one or as many as required to produce the desired image. Eight LED's are shown in FIG. 1 for illustrative purposes only. It is essential however that the array span the full height of the image to be produced, where height refers to the direction transverse to the direction of scan indicated by arrow (7), and that the number and the size of LED's be consistant with the level of detail in the desired image.

The example of FIG. 1 is configured to generate images of alphanumeric character strings and simple figures.

Means (6) for energising and modulating the LED's (2) is provided. Each LED (2) can be switched on and off independently. In operation, the modulator (6) switches each LED on/off at a rapid rate in accordance with a pattern that is determined by the specifics of the desired image. This action will be made explicit in following paragraphs, but for now let it be noted that the modulation is such that the entirety of the desired image is generated within about 0.005 to 0.025 seconds and repeated at a rate of about 20 to 40 times per second.

If the observer (5) looks directly at the array (1) while it is being modulated he would see only a steady glow from each LED.

However, if the observer first looks at point (3) then looks at point (4), he sees the desired image for a brief instant, because the time sequence of LED flashes becomes a static spatial sequence on the observers moving retina, owing to the phenomenon of visual persistence.

Figure 2:
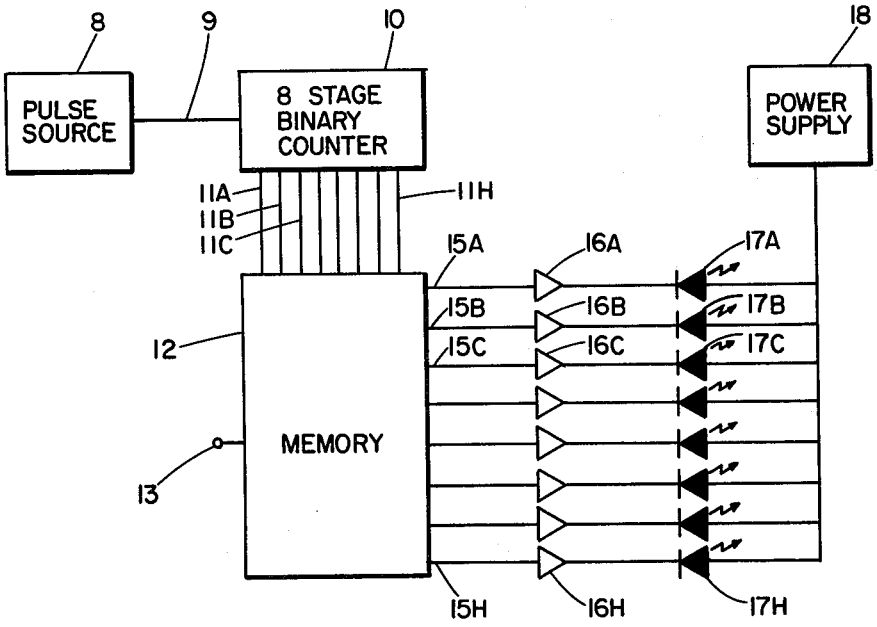
FIG. 2 is a diagrammatic view of a representative means for energising and sequentially modulating the array of FIG. 1.

Representative means for modulating the light producing elements in the manner required to achieve the above visual image effect is shown in FIG. 2, which is a block diagram of electrical logic circuit components well known in the art. It will be obvious to those versed in the art that other logic components can be used to produce an analogous result, such as by using a programmable microprocessor component, for example.

Pulse generator (8) generates a continuous train of pulses at a constant rate which may be ten kilohertz, for example, on line (9), which is connected to the input of binary pulse counter (10). Each pulse on line (9) increases the binary number of the counter by one, which number is present on the counter output lines (11*a*) through (11*h*). Counter (10) has eight binary stages in this embodiment, but more or fewer stages can be used according to the size of the desired image. Counter (10) having eight stages will count from (decimal) 0 to 256 repetitively, each count remaining on the output lines (11) for about 100 microseconds until the next pulse from pulse generator (8) increases the count.

Counter output lines (11) are connected to address input terminals of memory (12) which contains 256 addressable cells each storing one byte of eight binary bits of data. Again, more or fewer cells are more or fewer bits per cell can be specified to meet the specifics of the desired image.

Memory (12) is loaded through schematic input (13) with the data to form the desired image at some previous time using well known techniques for loading binary memory components. Memory (12) may be a fixed Read Only Memory in which case the desired image is invariant once the memory (12) is loaded. Memory (12) may also be of the Programmable Read Only Memory type or the volatile Random Access Memory type, if changes in the desired image are anticipated.

The action of memory (12) is such that the data stored in the cell defined by the number present on the address input terminals is presented on the memory output lines (15*a*) through (15*h*) within a brief setting time, typically less than 500 nanoseconds, after the address lines have settled.

Memory output lines (15) each connect to a light emitting diode (17*a*) through (17*h*) through a suitable driver device (16*a*) through (16*h*) as required to match the current delivering capabilities of the memory component (12) to the energising requirements of the light emitting diodes (17). In some instances requiring only low light output levels, drivers (16) may be omitted.

Light will radiate from LED's (17) in correspondance with the binary levels on memory output lines (15). Therefore, the data byte in memory cell number n is made visible by LED's (17) for an interval of about 100 microseconds until the count increases to n+1, and the data byte from memory cell n+1 becomes visible. When the binary data is "1" the corresponding LED is on, for binary "0" the LED is off, although it would be possible to modulate between other levels of intensity or between two colors.

Angular eye movement may be as great as 20 radians per second during saccadic motions. In 100 microseconds, the eye could move through an angle of 2 milliradians, smearing the LED's image on the eye's retina by this amount. In most applications of the current invention, this amount of smearing is inconsequential since it is close to the limit of resolution of the typical human eye and close to the angular width of the LED array at intended viewing distances.

From the foregoing explanation it is evident that the array of light emitting diodes (2) can be made to glow or be dark in accordance with the predefined pattern for a brief interval of 100 microseconds, in accordance with a second predefined arbitrary pattern for the following 100-microsecond interval, and so successively to the 256th predefined arbitrary pattern and 256th 100-microsecond interval.

Figure 3:
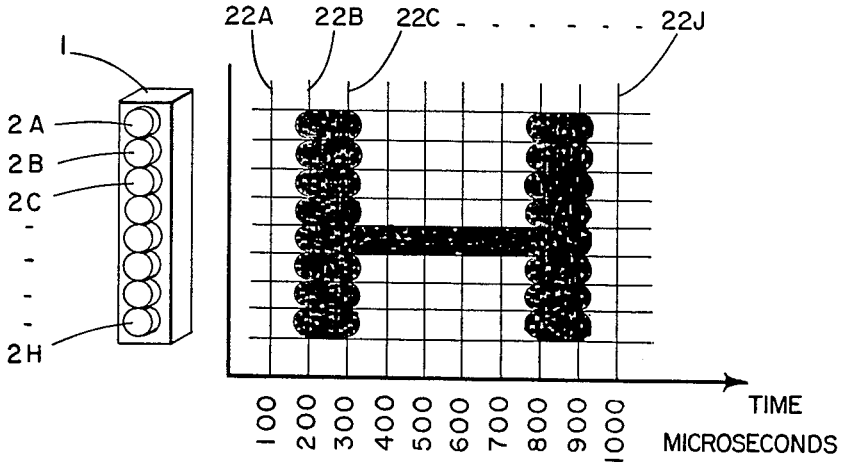
FIG. 3 is a diagrammatic view of the time sequence of the states of the array of FIG. 1 during the production of the image "H".

In this way an 8×256 dot-matrix image may be created, which using the well known dot-matrix encoding format can portray up to 32 alpha numeric characters, for example, FIG. 3 gives an illustration of the appearance of the array (1) during 10 successive 100-microsecond intervals (22*a*) through (22*j*) in which the desired image is that of the letter "H".

The LED's are continuously cycled through the 256 image segments every 25.6 milliseconds, or about 39 times per second. With saccadic eye motions of 5 radians per second, the eye moves through an arc of 128 milliradians in 25.6 milliseconds, which will be the angular extent of the perceived image should all memory cells be loaded with data. However, in practice it has been found less ambiguous if a conspicuous blank area is provided between repetitive cycles, so that the observer clearly perceives the start and finish of the image.

This may be achieved in the above example by leaving a succession of memory cells empty, although to one versed in the art there will occur alternative schemes that are more efficient of memory usage. For example, by adding one additional stage to counter (10) and disabling input terminal to the memory (12), the memory can be disabled on alternate cycles of the 25.6 millisecond image generation cycle, producing a blank space equal to the image space.

The absolute limits of human perception and recognition of images presented for brief exposures such as 25.6 milliseconds are yet to be found. Based on experiments by the inventor with the subject invention as described above in the preferred embodiment, an angular span of about 50 milliradians was found adequate for recognition of images of familiar words and phrases containing up to 14 letters. This is not to say, however, that other subject matter such as geographical outlines or random letters might not admit of much broader or narrower angular limits for recognition.

In the above description the components rates and sizes cited are meant to be representative of a workable embodiment. Clearly other rates and sizes near to those cited will produce nearly similar effects. However if the pulse generator is slowed too much, the image will ultimately exceed the angular recognition span of the human eye, and if it is speeded too much, the image will not be resolvable into recognisable symbols by head and eye saccadic movement alone.

Uncontrolled variables such as image content, LED brightness, background brightness and clutter, image line widths, observers eye dark adaptation, and observer physical condition make it impossible to place well defined upper and lower bounds on the essential variables of this invention to cover all conditions.

From the example given, one skilled in the art can define the essential variables in a way that optimizes the invention for any given message size, viewing distance background conditions and image resolution.

Figure 4:
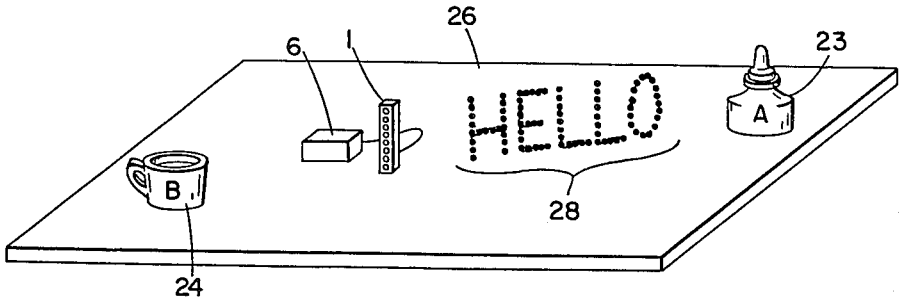
FIG. 4 is a perspective view of what the observer sees momentarily as he shifts his gaze to object B of the scene after fixing on object A when the array has been programmed to produce the visual image "HELLO".
Figure 4:
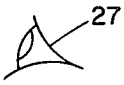

FIG. 4 illustrates where the momentary visual image (28) appears to be located to the observer (27). The array (1) and its modulator (6) are placed on a surface (26) between two objects (23) and (24) that serve as points of eye fixation. Observer (27) first looks at object (23) then looks at object (24). For a brief moment the observer will see a visual image (28), in this illustration the word "HELLO", flash at approximately the location shown in FIG. 4. The precise location and extent of the momentary visual image will vary slightly according to the moment at which the observer (27) initiates saccadic eye movement and to the precise speed of the observers saccadic movement.

Figure 5:
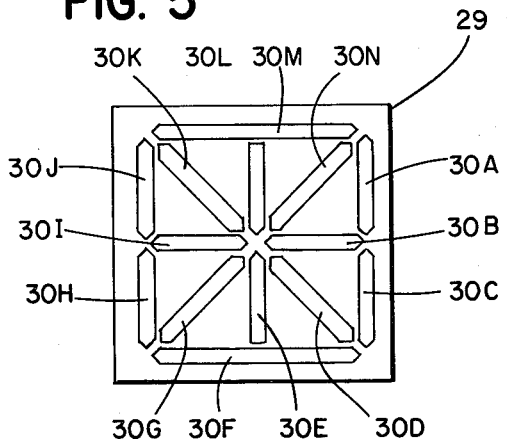
FIG. 5 is a frontal view of an alternative array of light producing elements extending in two dimensions.

An alternative array (29) of light producing elements is shown in FIG. 5, wherein are disposed 14 light producing elements (30*a*) through (30*h*), having an elongated or bar shape in a well known two dimensional arrangement for producing letters and numerals. The advantage of this array (29) is that fewer memory cells are required to produce an image of an alphanumeric symbol. For example, in the linear array (1) of the preferred embodiment, display of one alphanumeric character using the well known 7×5 dot matrix encoding scheme require 35 bits of memory. In the alternative array (29), one character requires only 14 bits of memory. The disadvantages of array (29) are that (a) only alphanumeric symbols can be displayed and (b) at slower eye scanning rates, the consecutive symbols will tend to overlap and become unreadable.

In use, array (29) would be energised for 100 microseconds with circuitry expanded to 14 lines but otherwise equivalent to that of FIG. 3.

Other modifications to the circuits are required as well: (a) to slow the pulse generator by a factor of about 8; (b) to reduce the counter to 5 stages; (c) to reconfigure the memory to 32 bytes of 14 bits each; and (d) to add a means for strobing the memory output lines so that LED's (30) are energised for only about 100 microseconds during each memory output cycle. To one versed in the art these modifications will be obvious.

Arc discharge tubes used in flash photography can be used. With the array of FIG. 5, life of the flash tubes would be increased tenfold since only 1/10 the number of flashes are required compared with the array of FIG. 1. Such a bright light source can be seen for great distances at night, but the short lifetime of the flash tubes would make this an expensive alternative.

A cathode ray tube with a short persistance phosphor such as P24 can be used as an array of light sources. The individual light emitting areas can be energised with separate electron beams or with a single electron beam suitably scanned, as would be obvious to one versed in the art.

The discrete light producing elements may also be steady continuous sources such as an incandescant lamp or a laser with high speed modulators interposed to effect the high rate of intensity modulation required by the subject invention. One such modulator is the electro-mechanically positioned mirror, one of which would be required for each light producing element, even though the originating source of light may be only a single incandescant lamp or laser.

Although different driver elements (16) would be required for suitable current or voltage amplification to meet the needs peculiar to the alternative light producing elements mentioned above, the operation and resulting momentary visual image effect would be as described in the preferred embodiment.

Figure 6:
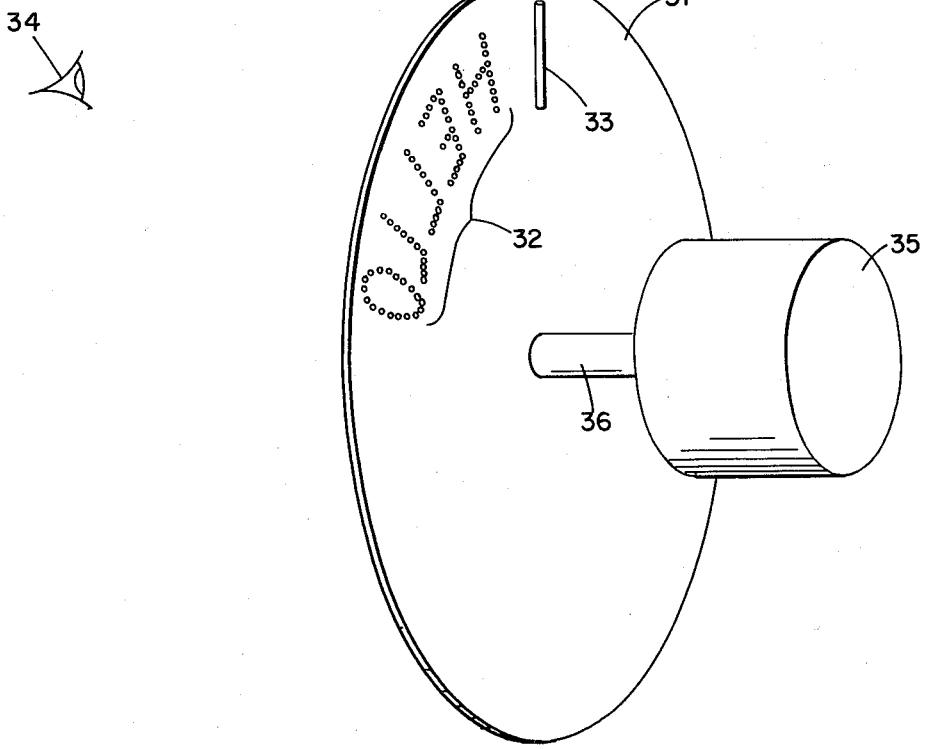
FIG. 6 is a perspective view of an alternative means for achieving the same visual effect as in FIGS. 1 through 4 using mechanical modulation of a single extended light source as opposed to electrical modulation of an array of light producing elements.

The equivalent momentary visual image effect can also be produced mechanically using an opaque rigid disc, FIG. 6. (31), containing perforations (32) in the form of the image to be created, a line source of light (33) behind the disc which is visible through only one column of perforations at a time, and by rapidly rotating the disc with motor-shaft (35)(36). The disadvantages of this alternative compared with the preferred embodiment are greater size, less flexibility, and greater power consumption. To create the same effect as the example cited in the preferred embodiment, the disc or cylinder would require a diameter of about 160 mm, a rotational speed of 2400 RPM, and a disc having 2048 suitably arranged perforations in order to produce an image 16 mm high and 32 characters in length.

A device as described in the preferred embodiment may be used in alternative ways. For example, if such a device be affixed to a rotating object such as a fan blade, bicycle wheel, anemoneter vane, or if it be merely whirled at the end of a string, the desired image can be made visible to the fixated eye, provided the pulse generator (8) is adjusted to suit the speed of movement and that the image be generated in about 1/10 second or less time so that the integrating effect of the eye's persistance is not lost. Exact synchronism of rotation and message is not required if the message be brief enough to be grasped by the eye/brain in a single exposure, which is, of course, part of the object of the subject invention. For example, the phrase "Happy Birthday" may be loaded into the memory of the preferred embodiment and it is clearly perceptible using saccadic eye movements when the pulse generator operates at about 10,000 pulses per second. When the preferred embodiment is suspended from a 25 cm length of string and rotated by hand in the manner of a policeman's billy, the phrase "Happy Birthday" is perceptible when the pulse generator operates at about 1,000 pulses per second. However, at this slower pulse rate, when the device is stationary saccadic eye movement can only perceive one or two letters of the phrase "Happy Birthday".

In the preferred embodiment, large image sizes and greater brightness can be achieved by using clusters of light emitting diodes for each light source in the array. Also for greater size and brightness the array may use light emitting electron beam/phosphor screen vacuum tubes such as are made by the Mitsubishi Corporation of Japan for use in large outdoor color television displays. The electron beam tubes emit red, green or blue light from a phosphor coated surface when energised by suitable electrical circuits. In effect they are fast switching colored light bulbs.

The preceding description is given merely by way of illustration. It is understood that various modifications may be made thereto without departing from the spirit of the invention as claimed.

I claim:

1. A device for presenting a two-dimensional image to an observer subject to saccadic eye movements characterized by variations in brightness across the image, comprising a fixed, one-dimensional light source comprising an array of light source areas and capable of delivering light of selectable brightness at each one of a plurality of positions along the light source, and a modulator for modulating the light source in accordance with said variations in brightness, over a time-period lasting between about 5 milliseconds and about 25 milliseconds for each displaying of said image.

2. The device of claim 1 wherein said image comprises a matrix of columns of said positions, and said modulator modulates said light source in accordance with a succession of frames, each frame corresponding to one of said columns.

3. The device of claim 1 wherein said modulator comprises a memory for storing information corresponding to said variations in the value of said brightness, and timing circuitry for delivering a succession of instructions to said light source to cause said intensity to vary in accordance with said stored information.

4. The device of claim 1 wherein said light source comprises a plurality of discrete light-delivering elements corresponding to said plurality of positions.

5. The device of claim 4 wherein said elements comprise light emitting diodes.

6. The device of claim 1 wherein said light source comprises a continuum of light delivering means.

7. The device of claim 6 wherein said modulator comprises a mechanical modulator having first portions arranged to pass light having a first value of said parameter and second portions arranged to pass light having a second value of said parameter, said modulating comprising moving said mechanical modulator relative to said light source.

8. The device of claim 7 wherein said mechanical modulator is a rotating disc.

9. The device of claim 7 wherein said mechanical modulator is a rotating cylinder surrounding said light source.

* * * * *

UNITED STATES PATENT AND TRADEMARK OFFICE

CERTIFICATE OF CORRECTION

PATENT NO. : 4,470,044

DATED : September 4, 1984

INVENTOR(S) : Bill Bell

It is certified that error appears in the above-identified patent and that said Letters Patent are hereby corrected as shown below:

Col. 2, line 21, "of" should be --or--.

Col. 4, line 66, "are" should be --and--.

Col. 5, line 24, "correspondance" should be --correspondence--.

Signed and Sealed this

Ninth Day of April 1985

[SEAL]

*Attest:*

DONALD J. QUIGG

*Attesting Officer* *Acting Commissioner of Patents and Trademarks*